US012018460B2

(12) United States Patent
Sano et al.

(10) Patent No.: US 12,018,460 B2
(45) Date of Patent: Jun. 25, 2024

(54) EXCAVATOR

(71) Applicant: SUMITOMO CONSTRUCTION MACHINERY CO., LTD., Tokyo (JP)

(72) Inventors: Kiminori Sano, Chiba (JP); Ryuji Shiratani, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 310 days.

(21) Appl. No.: 17/448,407

(22) Filed: Sep. 22, 2021

(65) Prior Publication Data

US 2022/0002975 A1 Jan. 6, 2022

Related U.S. Application Data

(63) Continuation of application No. PCT/JP2020/014354, filed on Mar. 27, 2020.

(30) Foreign Application Priority Data

Mar. 29, 2019 (JP) ..... 2019-068992

(51) Int. Cl.
*E02F 9/22* (2006.01)
*E02F 9/20* (2006.01)

(52) U.S. Cl.
CPC ..... *E02F 9/2246* (2013.01); *E02F 9/2296* (2013.01); *E02F 9/2029* (2013.01)

(58) Field of Classification Search
CPC ..... E02F 9/2246; E02F 9/2296; E02F 9/2029; E02F 9/2235; E02F 9/2282; E02F 9/2285; E02F 9/2292; E02F 9/2025; E02F 9/123; E02F 9/2221; F04B 2201/1202; F04B 2205/09; F04B 17/05; F04B 49/065; F15B 2211/20523; F15B 2211/20546; F15B 2211/6651; F15B 2211/6652; F15B 2211/6654; F15B 11/02; F02D 29/04
See application file for complete search history.

(56) References Cited

U.S. PATENT DOCUMENTS 8,266,903 B2 9/2012 Kowatari et al.
9,382,694 B2 7/2016 Kim et al.
(Continued)

FOREIGN PATENT DOCUMENTS

EP 1207304 5/2002
EP 2101065 9/2009
(Continued)

OTHER PUBLICATIONS

International Search Report for PCT/JP2020/014354 mailed on Jun. 23, 2020.

*Primary Examiner* — Brian P Sweeney
(74) *Attorney, Agent, or Firm* — IPUSA, PLLC

(57) ABSTRACT

An excavator may include a lower traveling body; an upper turning body pivotally installed to the lower traveling body; an engine installed in the upper turning body; a main pump driven by the engine; and a processor and a memory that stores program instructions causing the processor to control a flow rate of hydraulic oil discharged by the main pump. The program instructions can cause the processor to, when a load of the engine increases, delay a response of the main pump 14 until an actual torque of the engine rises up to a level corresponding to the load of the engine.

8 Claims, 5 Drawing Sheets

(56) References Cited

U.S. PATENT DOCUMENTS

| | | | | |
|---|---|---|---|---|
| 2009/0293470 | A1* | 12/2009 | Tsukamoto ..... | E02F 9/2296 60/459 |
| 2017/0130428 | A1 | 5/2017 | Matsuzaki et al. | |

FOREIGN PATENT DOCUMENTS

| | | | |
|---|---|---|---|
| GB | 2171757 | | 9/1986 |
| GB | 2544447 | | 5/2017 |
| JP | H05-157101 | | 6/1993 |
| JP | H05-064506 | U | 8/1993 |
| JP | H06-081773 | | 3/1994 |
| JP | 2000-154803 | | 6/2000 |
| JP | 2000-161302 | | 6/2000 |
| JP | 2000154803 | A * | 6/2000 |
| JP | 2001-193702 | | 7/2001 |
| JP | 2005-076670 | | 3/2005 |
| JP | 2007-040185 | | 2/2007 |
| JP | 2009-002318 | | 1/2009 |
| JP | 2014-055635 | | 3/2014 |
| JP | 2015-121087 | | 7/2015 |
| JP | 2017-096040 | | 6/2017 |
| WO | 2016/017674 | | 2/2016 |

* cited by examiner

EXCAVATOR

RELATED APPLICATION

This application is a continuation application filed under 35 U.S.C. 111(a) claiming benefit under 35 U.S.C. 120 and 365(c) of PCT International Application No. PCT/JP2020/014354, filed on Mar. 27, 2020, and designating the U.S., which claims priority to Japanese Patent Application No. 2019-068992 filed on Mar. 29, 2019. The entire contents of the foregoing applications are incorporated herein by reference.

BACKGROUND

Technical Field

The present disclosure relates to an excavator.

Description of Related Art

An excavator that controls a discharge rate of an oil hydraulic pump in such a manner that an absorbing torque of the oil hydraulic pump does not exceed a rated torque of an engine even when a discharge pressure of the oil hydraulic pump changes is known.

An actual torque of an engine that rotates at a predetermined speed is less than a rated torque when the engine load is low. The actual torque is then increased due to an increase in a fuel injection quantity when the engine load is increased and reaches the rated torque. Thus, the actual torque varies dynamically and rises with some delay when the engine load is increased.

SUMMARY

An excavator according to an embodiment of the present invention includes a lower traveling body; an upper turning body pivotally installed to the lower traveling body; an engine installed in the upper turning body; an oil hydraulic pump driven by the engine; and a processor and a memory that stores program instructions causing the processor to control a flow rate of hydraulic oil discharged by the oil hydraulic pump. The program instructions cause the processor to, when a load of the engine is increased, delay a response of the oil hydraulic pump until an actual torque of the engine rises to a level corresponding to the load of the engine.

DETAILED DESCRIPTION

Control of an excavator described above does not take into account a delay in rising up of an actual torque of an engine. Therefore, the above-described control of the excavator involves a risk that an absorbing torque of an oil hydraulic pump temporarily exceeds an actual torque of the engine and the engine speed decreases.

Therefore, it is desirable to more surely prevent an absorbing torque of an oil hydraulic pump from exceeding an actual torque of an engine.

An excavator according to an embodiment of the present invention includes a lower traveling body; an upper turning body pivotally installed to the lower traveling body; an engine installed in the upper turning body; an oil hydraulic pump driven by the engine; and a processor and a memory that stores program instructions causing the processor to control a flow rate of hydraulic oil discharged by the oil hydraulic pump. The program instructions cause the processor to, when a load of the engine is increased, delay a response of the oil hydraulic pump until an actual torque of the engine rises to a level corresponding to the load of the engine.

Figure 1:
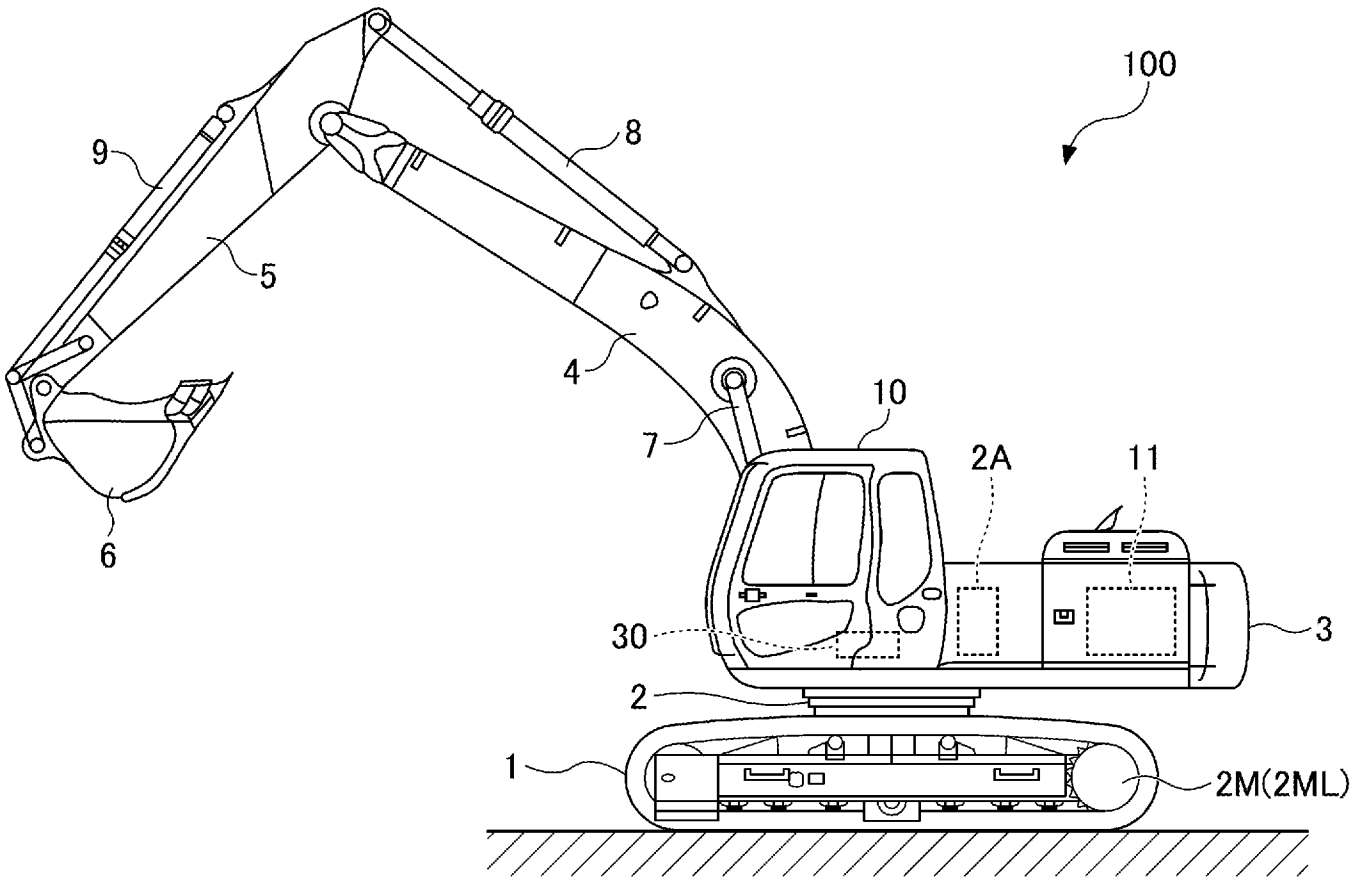
FIG. 1 is a side view of an excavator according to an embodiment of the present invention.

An excavator 100 according to an embodiment of the present invention will now be described with reference to FIG. 1. FIG. 1 is a side view of an excavator 100. According to the present embodiment, an upper turning body 3 is installed to a lower traveling body 1 in such a manner that the upper turning body 3 can rotate through a turning mechanism 2. The lower traveling body 1 is driven by a driving oil hydraulic motor 2M. The driving oil hydraulic motor 2M includes a left traveling oil hydraulic motor 2ML to drive a left crawler and a right traveling oil hydraulic motor 2MR to drive a right crawler (not visible in FIG. 1). The turning mechanism 2 is driven by a turning oil hydraulic motor 2A installed in the upper turning body 3. However, the turning oil hydraulic motor 2A may be a turning motor generator as an electric actuator.

A boom 4 is attached to the upper turning body 3. An arm 5 is attached to a distal end of the boom 4, and a bucket 6 as an end attachment is attached to a distal end of the arm 5. The boom 4, arm 5, and bucket 6 form a drilling attachment, which is an example of an attachment. The boom 4 is driven by a boom cylinder 7, the arm 5 is driven by an arm cylinder 8, and the bucket 6 is driven by a bucket cylinder 9.

The upper turning body 3 is provided with a cabin 10 as an operator's operating room, and also, a power source such as an engine 11 installed therein. A controller 30 is installed in the upper turning body 3. Hereinafter, for convenience, a side where the boom 4 is installed is referred to as a front side and a side where a counterweight is installed is referred to as a rear side, with respect to the upper turning body 3.

The controller 30 is used to control the excavator 100. In the present embodiment, the controller 30 includes a computer including a CPU, a volatile storage device, a non-volatile storage device, and the like. The controller 30 implements various functions by reading programs corresponding to various functional elements from the non-volatile storage device, loading them into the volatile storage device such as a RAM and causing the CPU to execute the corresponding processes.

Figure 2:
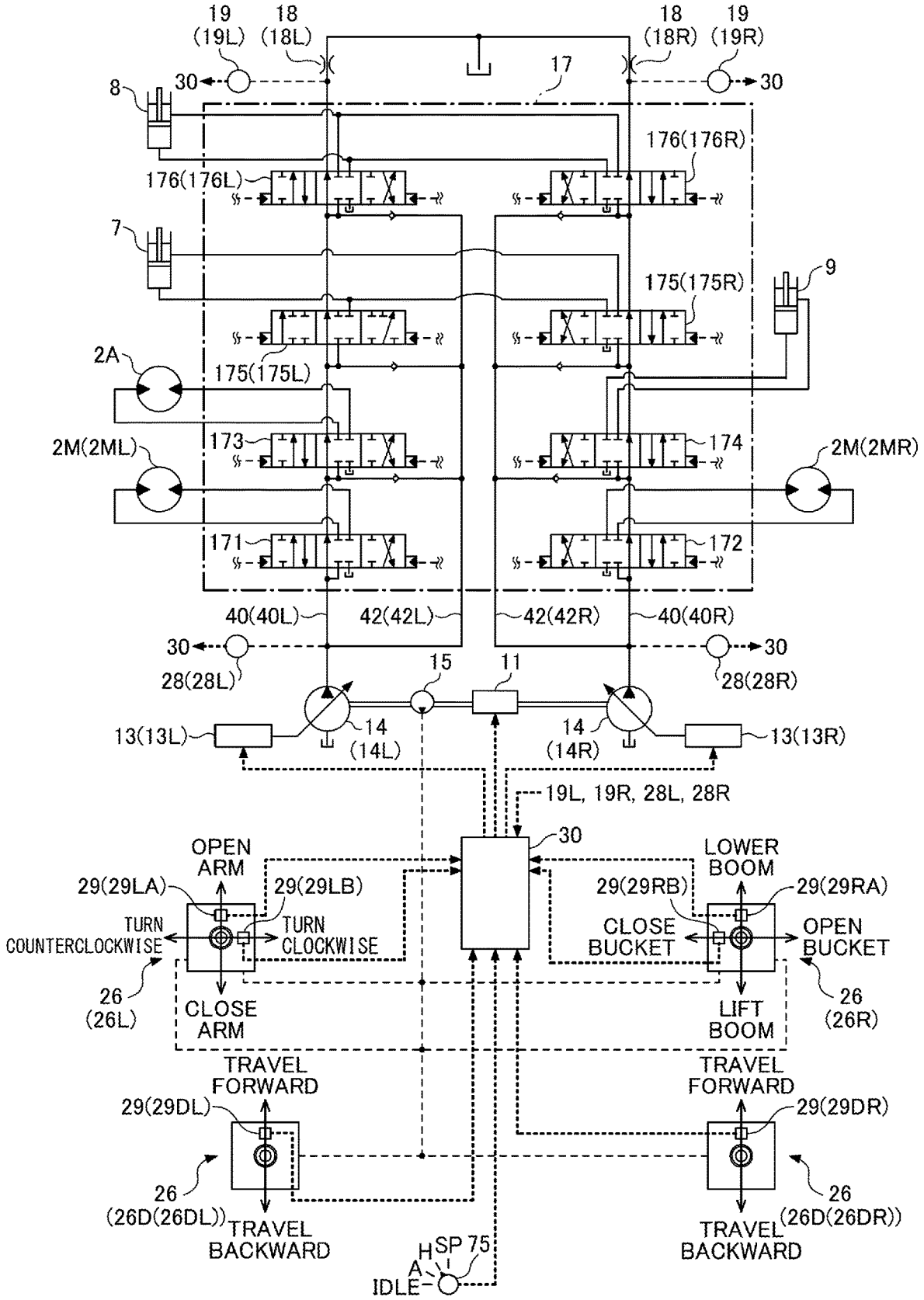
FIG. 2 is a diagram illustrating an example of a configuration of an oil hydraulic system installed in the excavator.

Next, a configuration example of an oil hydraulic system installed in the excavator 100 will be described with reference to FIG. 2. FIG. 2 illustrates an example of a configuration of an oil hydraulic system installed in the excavator 100. FIG. 2 depicts a mechanical power transmission system, hydraulic oil lines, pilot lines, and an electrical control system by double lines, solid lines, dashed lines, and dotted lines, respectively.

The oil hydraulic system of the excavator 100 includes, as major elements, the engine 11, regulators 13, main pumps 14, a pilot pump 15, control valves 17, operating devices 26, discharge pressure sensors 28, operating pressure sensors 29, the controller 30, an engine speed adjustment dial 75, and the like.

In FIG. 2, the oil hydraulic system circulates hydraulic oil from the main pumps 14 driven by the engine 11 to a hydraulic oil tank via at least center bypass pipe lines 40 or parallel pipe lines 42.

The engine 11 is a driving source of the excavator 100. In the present embodiment, the engine 11 is, for example, a diesel engine that runs to maintain a predetermined speed. Output shafts of the engine 11 are coupled to respective input shafts of the main pumps 14 and the pilot pump 15. The engine 11 is equipped with a supercharger. In the present embodiment, the supercharger is a turbocharger. The engine 11 is controlled by an engine control unit. The engine control unit, for example, adjusts a fuel injection quantity in response to a supercharged pressure (boost pressure). The boost pressure is detected, for example, by a boost pressure sensor.

The main pumps 14 supply hydraulic oil to the control valves 17 via the hydraulic oil lines. In the present embodiment, the main pumps 14 are electrically controlled oil hydraulic pumps. Specifically, the main pumps 14 are swash-plate-type variable-capacity oil hydraulic pumps.

The regulators 13 control discharge rates of the main pumps 14. In the present embodiment, the regulators 13 control discharge rates of the main pumps 14 by adjusting swash plate angles of the main pumps 14 in response to control instructions from the controller 30 to control displacements per revolution of the main pumps 14.

The pilot pump 15 supplies hydraulic oil to oil hydraulic control devices including operating devices 26 via pilot lines. In the present embodiment, the pilot pump 15 is a fixed-displacement oil hydraulic pump. The pilot pump 15 may be omitted. In this case, the function performed by the pilot pump 15 may be implemented by the main pumps 14. That is, the main pump 14 may be provided with a function of supplying hydraulic oil to the control valves 17, as well as a function of supplying hydraulic oil to the operating devices 26 after the pressure of the hydraulic oil is lowered by a restrictor or the like.

The control valves 17 are oil hydraulic controllers for controlling the oil hydraulic system in the excavator 100. In the present embodiment, the control valves 17 includes control valves 171-176, which are surrounded by an alternate long and short dashed line in the figure. The control valves 175 include a control valve 175L and a control valve 175R, whereas the control values 176 include a control valve 176L and a control valve 176R. The control valves 17 can selectively supply hydraulic oil discharged by the main pumps 14 to one or more oil hydraulic actuators through the control valves 171-176. The control valves 171-176 control flow rates of hydraulic oil from the main pumps 14 to the oil hydraulic actuators and flow rates of hydraulic oil from the oil hydraulic actuators to the hydraulic oil tank. The hydraulic actuators include a boom cylinder 7, an arm cylinder 8, a bucket cylinder 9, a left traveling oil hydraulic motor 2ML, a right traveling oil hydraulic motor 2MR, and a turning oil hydraulic motor 2A.

The operating devices 26 are used by an operator for operating actuators. The actuators includes at least oil hydraulic actuators or electric actuators. In the present embodiment, the operating devices 26 supply via the pilot lines hydraulic oil discharged by the pilot pump 15 to pilot ports of the control valves 17. A pilot pressure, which is a pressure of hydraulic oil supplied to each of the pilot ports, is a pressure corresponding to a direction and an amount of an operation of a lever or a pedal (not depicted) of the operating device 26 by the operator corresponding to each of the oil hydraulic actuators.

The discharge pressure sensors 28 detect discharge pressures of the main pumps 14. In the present embodiment, the discharge pressure sensors 28 output detected values to the controller 30.

The operating pressure sensors 29 detect operations performed by the operator via the operating devices 26. In the present embodiment, the operating pressure sensors 29 detect, in the form of pressures (operating pressures), directions and amounts of operations of the levers or the pedals as the operating devices 26 by the operator corresponding to the respective actuators and output detected values to the controller 30. Operations of the operating devices 26 may be detected using sensors other than the operating pressure sensors.

The main pumps 14 includes a left main pump 14L and a right main pump 14R. The left main pump 14L circulates hydraulic oil through a left center bypass pipe line 40L or a left parallel pipe line 42L to the hydraulic oil tank, and the right main pump 14R circulates hydraulic oil through a right center bypass pipe line 40R or a right parallel pipe line 42R to the hydraulic oil tank.

The left center bypass pipe line 40L is a hydraulic oil line passing through the control valves 171, 173, 175L and 176L included in the control valves 17. The right center bypass pipe line 40R is a hydraulic oil line passing through the control valves 172, 174, 175R and 176R included in the control valves 17.

The control valve 171 is a spool valve used to switch a flow of hydraulic oil to supply hydraulic oil discharged by the left main pump 14L to the left traveling oil hydraulic motor 2ML and to discharge hydraulic oil discharged by the left traveling oil hydraulic motor 2ML to the hydraulic oil tank.

The control valve 172 is a spool valve used to switch a flow of hydraulic oil to supply hydraulic oil discharged by the right main pump 14R to the right driving oil hydraulic motor 2MR and to discharge hydraulic oil discharged by the right traveling oil hydraulic motor 2MR to the hydraulic oil tank.

The control valve 173 is a spool valve used to switch a flow of hydraulic oil to supply hydraulic oil discharged by the left main pump 14L to the turning oil hydraulic motor 2A and to discharge hydraulic oil discharged by the turning oil hydraulic motor 2A to the hydraulic oil tank.

The control valve 174 is a spool valve used to switch a flow of hydraulic oil to supply hydraulic oil discharged by the right main pump 14R to the bucket cylinder 9 and to discharge hydraulic oil in the bucket cylinder 9 to the hydraulic oil tank.

The control valve 175L is a spool valve used to switch a flow of hydraulic oil to supply hydraulic oil discharged by the left main pump 14L to the boom cylinder 7. The control valve 175R is a spool valve used to switch a flow of hydraulic coil to supply hydraulic oil discharged by the right main pump 14R to the boom cylinder 7 and to discharge hydraulic oil in the boom cylinder 7 to the hydraulic oil tank.

The control valve 176L is a spool valve used to switch a flow of a hydraulic oil to supply hydraulic oil discharged by the left main pump 14L to the arm cylinder 8 and to discharge hydraulic oil in the arm cylinder 8 to the hydraulic oil tank. The control valve 176R is a spool valve used to switch a flow of hydraulic oil to supply hydraulic oil discharged by the right main pump 14R to the arm cylinder 8 and to discharge hydraulic oil in the arm cylinder 8 to the hydraulic oil tank.

The left parallel pipe line 42L is a hydraulic oil line parallel to the left center bypass pipe line 40L. The left parallel pipe line 42L supplies hydraulic oil to a control valve on a downstream side when a flow of hydraulic oil passing through the left center bypass pipe line 40L is restricted or interrupted by any one of the control valves 171, 173, and 175L. The right parallel pipe line 42R is a hydraulic oil line parallel to the right center bypass pipe line 40R. The right parallel pipe line 42R supplies hydraulic oil to a control valve on a downstream side when any one of the control valves 172, 174, and 175R restricts or interrupts a flow of hydraulic oil passing through the right center bypass pipe line 40R.

The regulators 13 include a left regulator 13L and a right regulator 13R. The left regulator 13L controls a discharge rate of the left main pump 14L by adjusting a tilt angle of the swash plate of the left main pump 14L in accordance with a discharge pressure of the left main pump 14L. This control is referred to as power control or horsepower control. Specifically, for example, the left regulator 13L adjusts a swash plate tilt angle of the left main pump 14L in response to an increase in a discharge pressure of the left main pump 14L to reduce a displacement per revolution, thereby reducing a discharge rate. The same applies to the right regulator 13R. This is to prevent absorbing power (e.g., absorbing horsepower) of the main pump 14, which is expressed as a product of a discharge pressure and a discharge rate, from exceeding output power (e.g., output horsepower) of the engine 11.

The operating devices 26 include a left operating lever 26L, a right operating lever 26R, and traveling levers 26D. The traveling levers 26D includes a left traveling lever 26DL and a right traveling lever 26DR.

The left operating lever 26L is used for a turning operation and an operation of the arm 5. The left operating lever 26L, when being operated in a forward or backward direction, utilizes hydraulic oil discharged by the pilot pump 15 to introduce a pilot pressure in accordance with a lever operation amount to a pilot port of the control valve 176. When being operated in a left or right direction, hydraulic oil discharged by the pilot pump 15 is used to introduce a pilot pressure in accordance with a lever operation amount into a pilot port of the control valve 173.

Specifically, when being operated in an arm closing direction, the left operating lever 26L introduces hydraulic oil to a right pilot port of the control valve 176L and introduces hydraulic oil to a left pilot port of the control valve 176R. When being operated in an arm opening direction, the left operating lever 26L introduces hydraulic oil to a left pilot port of the control valve 176L and introduces hydraulic oil to a right pilot port of the control valve 176R. When being operated in a counterclockwise turning direction, the left operating lever 26L introduces hydraulic oil to a left pilot port of the control valve 173, whereas, when being operated in a clockwise turning direction, the left operating lever 26L introduces hydraulic oil to a right pilot port of the control valve 173.

The right operating lever 26R is used to operate the boom 4 and the bucket 6. The right operating lever 26R, when being operated in a forward or backward direction, utilizes hydraulic oil discharged by the pilot pump 15 to introduce a pilot pressure in accordance with a lever operation amount into a pilot port of the control valve 175. When being operated in a left or right direction, the right operating lever 26R utilizes hydraulic oil discharged by the pilot pump 15 to introduce a pilot pressure in accordance with a lever operating amount into a pilot port of the control valve 174.

Specifically, the right operating lever 26R, when being operated in a boom lowering direction, introduces hydraulic oil to a right pilot port of the control valve 175R. The right operating lever 26R, when being operated in a boom lifting direction, introduces hydraulic oil to a right pilot port of the control valve 175L, and introduces hydraulic oil to a left pilot port of the control valve 175R. The right operating lever 26R introduces hydraulic oil to a left pilot port of the control valve 174 when being operated in a bucket closing direction, and introduces hydraulic oil to a right pilot port of the control valve 174 when being operated in a bucket opening direction.

The traveling levers 26D are used to operate the crawlers. Specifically, the left traveling lever 26DL is used to operate the left crawler. The left traveling lever 26DL may be linked with a left traveling pedal. The left traveling lever 26DL, when being operated in a forward or backward direction, utilizes hydraulic oil discharged by the pilot pump 15 to introduce a pilot pressure in accordance with a lever operating amount into a pilot port of the control valve 171. The right traveling lever 26DR is used to operate the right crawler. The right traveling lever 26DR may be linked with a right traveling pedal. The right traveling lever 26DR, when being operated in a forward or backward direction, utilizes hydraulic oil discharged by the pilot pump 15 to introduce a pilot pressure in accordance with a lever operating amount into a pilot port of the control valve 172.

The discharge pressure sensors 28 include a discharge pressure sensor 28L and a discharge pressure sensor 28R. The discharge pressure sensor 28L detects a discharge pressure of the left main pump 14L and outputs a detected value to the controller 30. The same applies to the discharge pressure sensor 28R.

The operating pressure sensors 29 includes operating pressure sensors 29LA, 29LB, 29RA, 29RB, 29DL, and 29DR. The operating pressure sensor 29LA detects a forward or backward operation with respect to the left operating lever 26L in the form of pressure and outputs a detected value to the controller 30. A detected operation includes, for example, a lever operating direction and a lever operating amount (a lever operating angle).

Similarly, the operating pressure sensor 29LB detects a leftward or rightward operation with respect to the left operating lever 26L in the form of pressure and outputs a detected value to the controller 30. The operating pressure sensor 29RA detects a forward or backward operation with respect to the right operating lever 26R in the form of pressure and outputs a detected value to the controller 30. The operating pressure sensor 29RB detects a leftward or rightward operation with respect to the right operating lever 26R in the form of pressure and outputs a detected value to the controller 30. The operating pressure sensor 29DL detects a forward or backward operation with respect to the left traveling lever 26DL in the form of pressure and outputs a detected value to the controller 30. The operating pressure sensor 29DR detects a forward or backward operation with respect to a right traveling lever 26DR in the form of pressure and outputs a detected value to the controller 30.

The controller 30 may receive outputs of the operating pressure sensors 29 and, as necessary, output control commands to the regulators 13 to vary discharge rates of the main pumps 14.

The controller 30 performs negative control as an energy saving control using restrictors 18 and control pressure sensors 19. The restrictors 18 include a left restrictor 18L and a right restrictor 18R, and the control pressure sensors 19 include a left control pressure sensor 19L and a right control pressure sensor 19R. In the present embodiment, the control pressure sensors 19 function as negative control pressure sensors. Energy saving control is control in which discharge rates of the main pumps 14 are reduced in order to reduce useless energy consumptions by the main pumps 14.

In the left center bypass pipe line 40L, a left restrictor 18L is disposed between the control valve 176L, which is the most downstream control value, and the hydraulic oil tank. Therefore, a flow of hydraulic oil discharged by the left main pump 14L is limited by the left restrictor 18L. The left restrictor 18L generates a control pressure (a negative control pressure) for controlling the left regulator 13L. The left control pressure sensor 19L is a sensor for detecting the control pressure and outputs a detected value to the controller 30. The controller 30 controls a discharge rate of the left main pump 14L through negative control by adjusting the tilt angle of the swash plate of the left main pump 14L in accordance with the control pressure. The controller 30 decreases a discharge rate of the left main pump 14L as the control pressure increases, and increases a discharge rate of the left main pump 14L as the control pressure decreases. A discharge rate of also the right main pump 14R is similarly controlled.

Specifically, when none of the oil hydraulic actuators in the excavator 100 is operated as depicted in FIG. 2, that is, when the excavator 100 is in a standby state, hydraulic oil discharged by the left main pump 14L reaches the left restrictor 18L through the left center bypass pipe line 40L. A flow of hydraulic oil discharged by the left main pump 14L increases a control pressure generated on the upstream side of the left restrictor 18L. As a result, the controller 30 reduces a discharge rate of the left main pump 14L to a standby flow rate and reduces a pressure loss (a pumping loss) at a time when discharged hydraulic oil passes through the left center bypass pipe line 40L. The standby flow rate is a predetermined flow rate for a standby state, for example, is an allowable minimum discharge rate. On the other hand, when any one of the oil hydraulic actuators is operated, hydraulic oil discharged by the left main pump 14L flows into the operated oil hydraulic actuator through a corresponding control valve. The control valve corresponding to the operated oil hydraulic actuator decreases a flow rate of hydraulic oil flowing to the left restrictor 18L or causes the flow rate of hydraulic oil to become zero, thereby lowering a control pressure generated on the upstream side of the left restrictor 18L. As a result, the controller 30 increases a discharge rate of the left main pump 14L to circulate sufficient hydraulic oil in the operated oil hydraulic actuator to surely drive the operated oil hydraulic actuator. The controller 30 controls a discharge rate of the right main pump 14R in the same manner.

This negative control described above allows the oil hydraulic system of FIG. 2 to reduce useless energy consumption at the main pump 14 in a standby state. Useless energy consumption includes a pumping loss generated in the center bypass pipe line 40 by hydraulic oil discharged by the main pump 14. The oil hydraulic system of FIG. 2 also ensures that sufficient hydraulic oil is supplied from the main pump 14 to an operated oil hydraulic actuator when the oil hydraulic actuator is operated.

The engine speed adjustment dial 75 is a dial for the operator to adjust a speed of the engine 11. The engine speed adjustment dial 75 transmits data indicating an engine speed setting state to the controller 30. In the present embodiment, the engine speed adjustment dial 75 switches an engine speed in four stages: an SP mode, an H mode, an A mode, and an IDLE mode. The SP mode is a speed mode selected when a workload is desired to be prioritized, using the highest engine speed. The H mode is a speed mode selected to achieve both workload and fuel economy, and uses a second highest engine speed. The mode A is a speed mode selected to operate the excavator 100 with low noise while prioritizing fuel economy, and uses a third highest engine speed. The IDLE mode is a speed mode selected when the engine 11 is to be in an idling state, and uses the lowest engine speed. An engine speed of the engine 11 is controlled to be constant at an engine speed according to a speed mode that is set by the engine speed adjustment dial 75.

Figure 3:
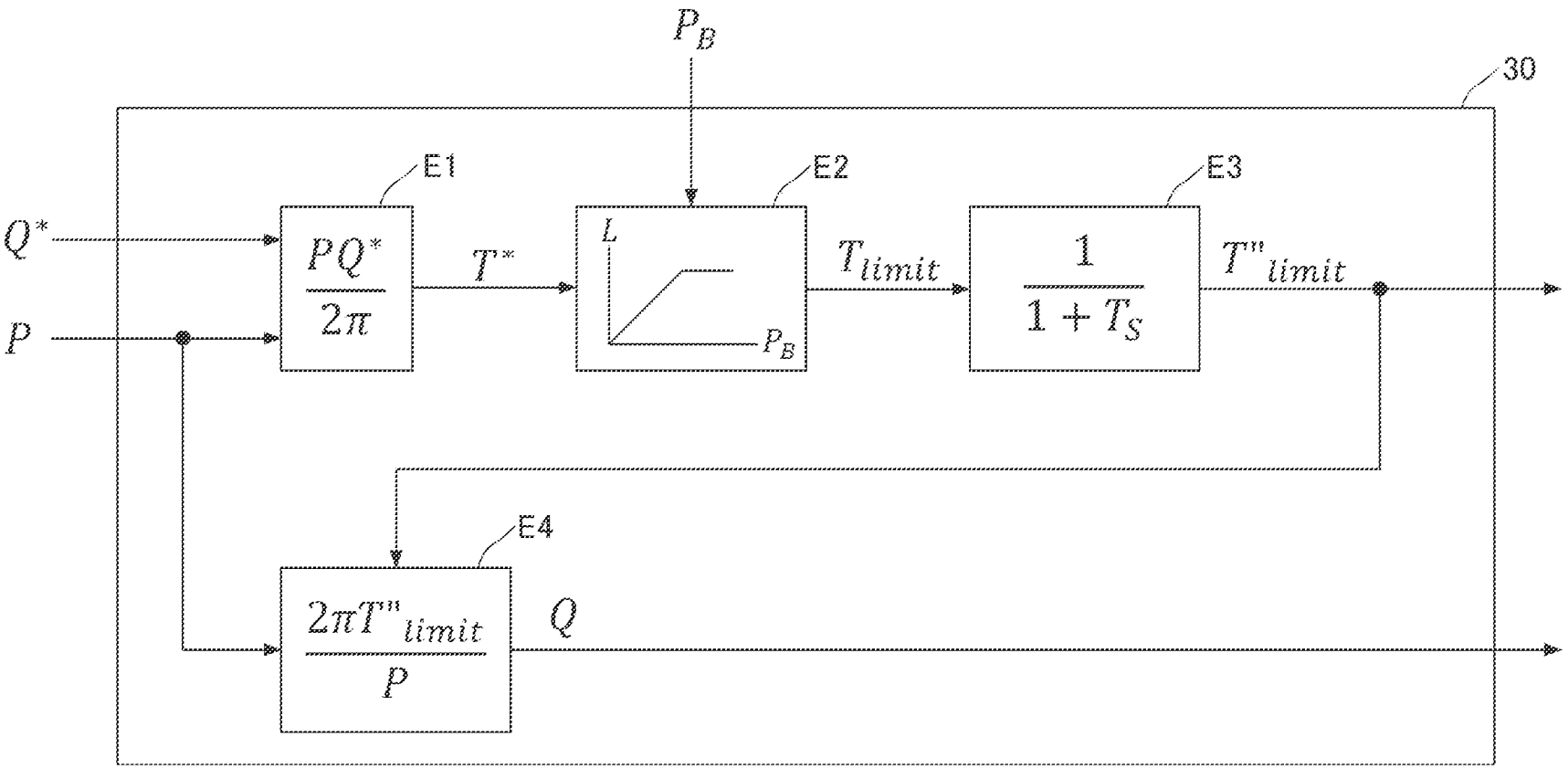
FIG. 3 is a diagram illustrating an example of a configuration of a controller.

Next, a process of reducing variations of flow rate command values Q output by the controller 30 to the regulators 13 (hereinafter referred to as a "variation reducing process") will be described with reference to FIG. 3. FIG. 3 is a diagram illustrating an example of a configuration of the controller 30.

In the present embodiment, the controller 30 includes a required torque calculating unit E1, a torque limiting unit E2, a variation reducing unit E3, and a flow rate command calculating unit E4. The controller 30 receives a required flow rate Q*, a discharge pressure P, a boost pressure $P_B$, etc. as inputs, and outputs a torque limit $T''_{limit}$, a flow rate command value Q, etc., every predetermined control cycle.

A required flow rate Q* is calculated as a flow rate of hydraulic oil to be discharged by the main pump 14. The controller 30 calculates the required flow rate Q* based on at least, for example, a control pressure detected by the control pressure sensor 19, a discharge pressure detected by the discharge pressure sensor 28, or an operating pressure detected by the operating pressure sensor 29. The required flow rate Q* may be calculated by the control pressure sensor 19. In this case, the control pressure sensor 19 outputs a required flow rate Q* to the controller 30. In the present embodiment, the controller 30 calculates a required flow rate Q* based on a control pressure detected by the control pressure sensor 19.

The required torque calculating unit E1 calculates a required torque T*. The required torque T* is a value calculated as a torque required to achieve a required flow rate Q*. According to the present embodiment, the required torque calculating unit E1 receives a required flow rate Q* and a discharge pressure P as inputs, and calculates a required torque T* using Formula (1).

$$T^* = \frac{P \times Q^*}{2 \times \pi} \tag{1}$$

The torque limiting unit E2 limits a required torque T*. In the present embodiment, the torque limiting unit E2 limits a required torque T* so that the required torque T* does not exceed a rated torque of the engine 11. Specifically, the torque limiting unit E2 receives a required torque T* calculated by the required torque calculating unit E1 and a boost pressure $P_B$ detected by the boost pressure sensor as inputs, and outputs an allowable torque $T_{limit}$ to the variation reducing unit E3. More specifically, the torque limiting unit E2 calculates an allowable torque $T_{limit}$ based on a load factor L, which is uniquely determined in accordance with the boost pressure $P_B$. The load factor L (%) is, for example, a ratio of an allowable torque $T_{limit}$ to the rated torque of the engine 11. Formula (2) depicts relationships between an allowable torque $T_{limit}$, a required torque T*, and a load factor L(%).

$$T_{limit}=T^*\times L \tag{2}$$

The variation reducing unit E3 reduces a variation of an allowable torque $T_{limit}$. In the present embodiment, the variation reducing unit E3 functions as a first-order lag filter having a time constant $T_S$ and limits a range of a variation of an allowable torque $T_{limit}$, every predetermined control cycle. Specifically, the variation reducing unit E3 receives an allowable torque $T_{limit}$ calculated by the torque limiting unit E2 as an input, and outputs a torque limit $T''_{limit}$ to the flow rate command calculating unit E4.

The flow rate command calculating unit E4 calculates a flow rate command value Q to be output to the regulator 13. In the present embodiment, the flow rate command calculating unit E4 receives a discharge pressure P detected by the discharge pressure sensor 28 and the torque limit $T''_{limit}$ calculated by the variation reducing unit E3 as inputs, and calculates a flow rate command value Q using Formula (3).

$$Q=\frac{2\times\pi\times T''_{limit}}{P} \tag{3}$$

Thus, the controller 30 obtains an output state (a torque limit $T''_{limit}$) of the engine 11 based on a required flow rate Q* and a discharge pressure P using the torque limiting unit E2 and the variation reducing unit E3, and calculates a flow rate command value Q corresponding to the output state of the engine 11 using the flow rate command calculating unit E4. The above-described configuration prevents the controller 30 from excessively increasing a flow rate command value Q before a boost pressure $P_B$ rises sufficiently. Thus, the controller 30 can prevent an absorbing torque of a main pumps 14 from being excessively increased when an actual torque of the engine 11 is low. That is, the controller 30 prevents an absorbing torque of the main pumps 14 from increasing sharply resulting in a sharp decrease in an engine speed when an actual torque of the engine 11 is low. In fact, even in a case where an absorbing torque of the main pumps 14 is lower than the rated torque of the engine 11, an engine speed decreases when an absorbing torque of the main pump 14 exceeds an actual torque of the engine 11. An absorbing torque of the main pump 14 is typically expressed by a product of a discharge pressure and a discharge rate. Thus, by preventing an absorbing torque of the main pump 14 from exceeding an actual torque of the engine 11, the controller 30 can more surely prevent an engine speed from falling before a boost pressure $P_B$ rises sufficiently.

Figure 4:
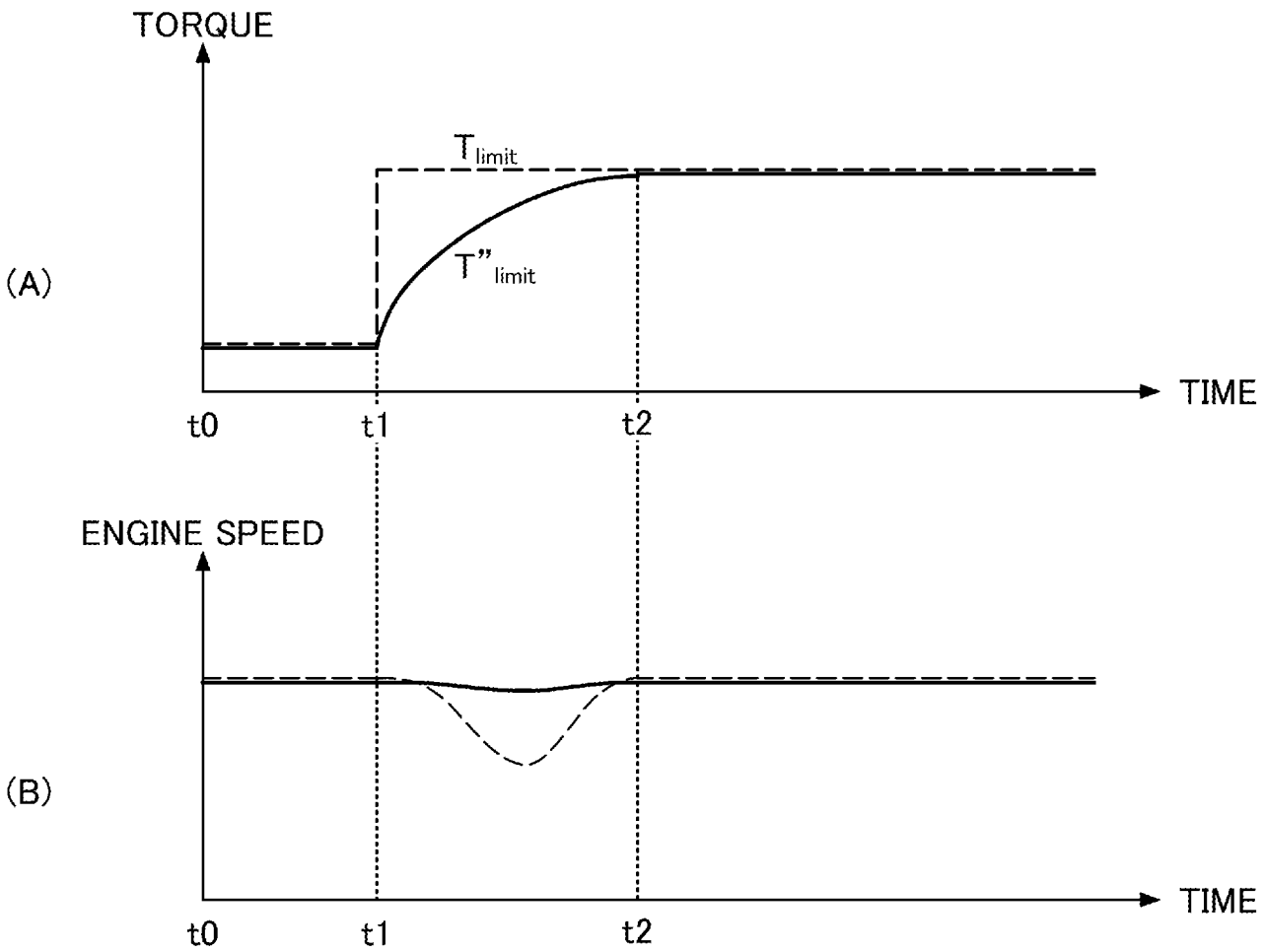
FIG. 4 depicts an example of a temporal change of values related to a variation reducing process when a boom lifting operation is performed.

Next, advantageous effects of a variation reducing process will be described with reference to FIG. 4. FIG. 4 depicts a temporal transition of values related to a variation reducing process when a boom-lifting operation is performed. Specifically, FIG. 4 includes FIG. 4 (A) and FIG. 4 (B). FIG. 4 (A) depicts a temporal transition of values related to a torque. The values related to a torque include an allowable torque $T_{limit}$ and a torque limit $T''_{limit}$. FIG. 4 (B) depicts a temporal transition of an engine speed.

More specifically, the dashed line in FIG. 4 (A) indicates a temporal transition of an allowable torque $T_{limit}$ derived by the torque limiting unit E2 every predetermined control cycle. The solid line in FIG. 4 (A) indicates a temporal transition of a torque limit $T''_{limit}$ derived by the variation reducing unit E3 every predetermined control cycle. The dashed line in FIG. 4 (B) indicates a temporal transition of an engine speed for a case where the variation reducing unit E3 is not provided, that is, for a case where an allowable torque limit $T_{limit}$ is input to the flow rate command calculating unit E4 instead of a torque limit $T''_{limit}$. The solid line in FIG. 4 (B) indicates a temporal transition of an engine speed for a case where the variation reducing unit E3 is provided, that is, for a case where a torque limit $T''_{limit}$ is input to the flow rate command calculating unit E4.

From the time t0 to the time t1, the engine 11 does not have an oil hydraulic load due to working applied thereto. Even during this period, the controller 30 estimates an output state (a torque limit $T''_{limit}$) of the engine 11 based on a required flow rate Q* and a discharge pressure P using the torque limiting unit E2 and the variation reducing unit E3, and calculates a flow rate command value Q corresponding to the output state of the engine 11 using the flow rate command calculating unit E4. Accordingly, the controller 30 calculates a torque limit $T''_{limit}$ that delays a response of the main pump 14 also before a load on the engine 11 increases. As a result, the controller 30 calculates a flow rate command value Q that delays a response of the main pump 14.

Thus, the controller 30 can reduce an engine output by calculating a small flow rate command value Q in a state where a heavy load is not applied.

At the time t1, in response to the right operating lever 26R being operated in the boom-lifting direction, a control pressure detected by the control pressure sensor 19 decreases because the control valve 175 moves to shut off the center bypass pipe line 40. Therefore, a required flow rate Q*, which is calculated based on the control pressure, increases as the control pressure decreases. Meanwhile, a discharge pressure P detected by the discharge pressure sensor 28 increases in response to an increase in an actual discharge rate due to an increase in a required flow rate Q*. Therefore, a required torque T*, which is calculated on the basis of the required flow rate Q* and the discharge pressure P, increases sharply, and an allowable torque $T_{limit}$, which is calculated on the basis of the required torque 1*, also increases sharply, as indicated by the dashed line in FIG. 4 (A).

In a case where the variation reducing unit E3 is not provided, that is, in a case where an allowable torque $T_{limit}$ is input to the flow rate command calculating unit E4 instead of a torque limit $T''_{limit}$, an engine speed decreases as indicated by the dashed line in FIG. 4 (B). This is because the absorbing torque of the main pump 14 temporarily exceeds the actual torque of the engine 11. This is because an actual discharge rate of a flow rate command value Q, that is, an actual discharge rate of the main pump 14 becomes greater than that in a case where the variation reducing unit E3 is provided, that is, in a case where a torque limit $T''_{limit}$ is input to the flow rate command calculating unit E4. Such a sharp increase in an actual discharge rate of the main pump 14 may occur also in a case where a required flow rate Q* is, as it is, used as a flow rate command value Q.

Therefore, in the example of FIG. 4, the controller 30 (the flow rate command calculating unit E4) determines a flow rate command value Q based on a torque limit $T''_{limit}$ calculated by the variation reducing unit E3, thereby reducing a sharp increase in the actual discharge rate of the main pump 14. As a result, the controller 30 can maintain an engine speed as indicated by the solid line in FIG. 4 (B), and prevent a significant decrease in an engine speed as indicated by the dashed line in FIG. 4 (B). This is because the controller 30 can prevent an absorbing torque of the main pump 14 from exceeding an actual torque of the engine 11.

Figure 5:
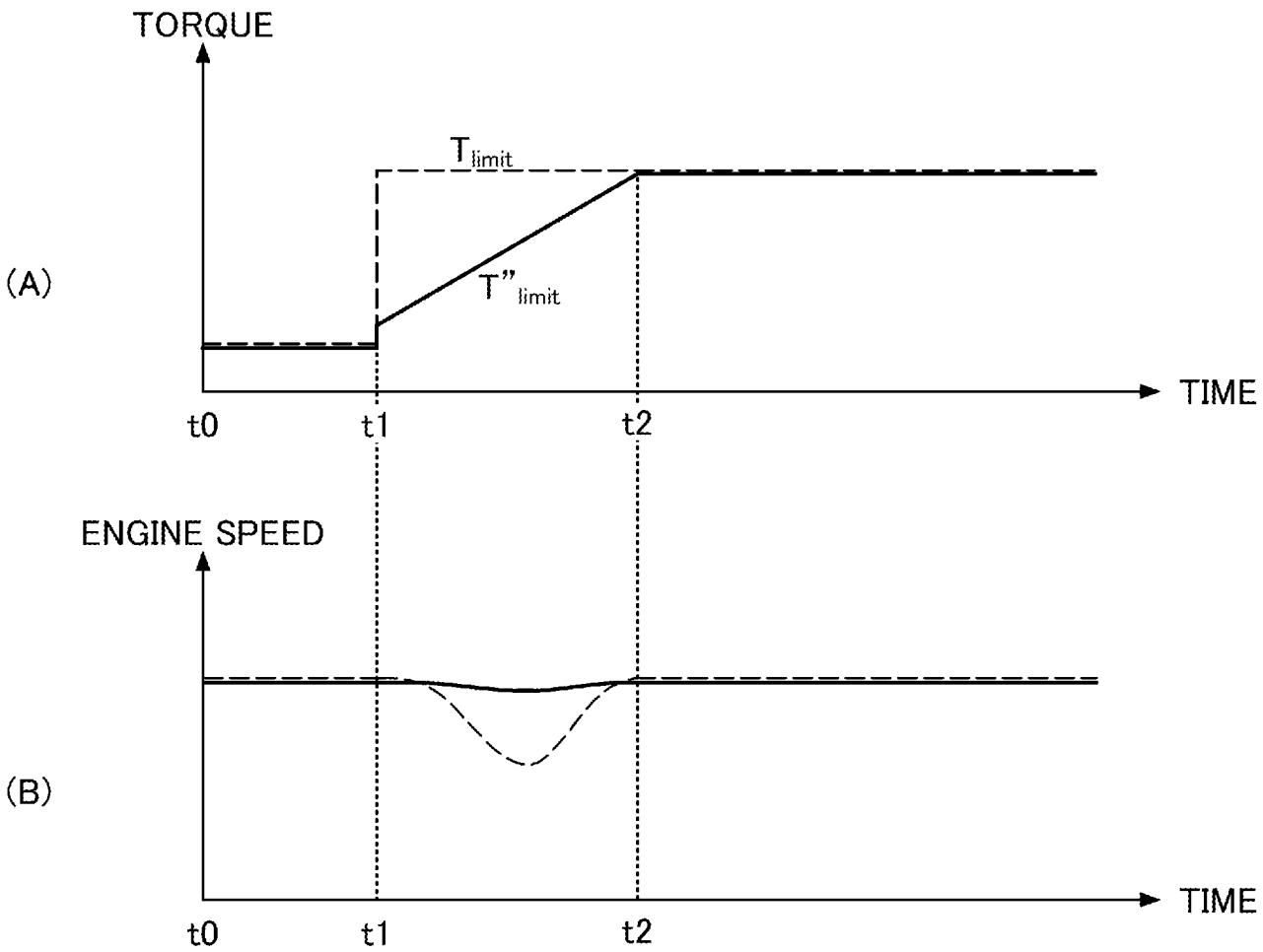
FIG. 5 depicts another example of a temporal change of values related to a variation reducing process when a boom lifting operation is performed.

Next, advantageous effects of the variation reducing process using the controller 30 including a different variation reducing unit E3 will be described with reference to FIG. 5. FIG. 5 depicts a temporal transition of values related to the variation reducing process for when a boom-lifting operation is performed, similar to FIG. 4. Specifically, FIG. 5 includes FIG. 5 (A) and FIG. 5 (B). FIG. 5 (A) depicts a temporal transition of torque values. The torque values include an allowable torque $T_{limit}$ and a torque limit $T''_{limit}$. FIG. 5 (B) depicts a temporal transition of an engine speed.

In the example of FIG. 5, the variation reducing unit E3 determines a torque limit $T''_{limit}$ based on a difference $\Delta\omega$ between a target engine speed $\omega^*$ and an actual engine speed $\omega$ of the engine 11.

The target engine speed $\omega^*$ of the engine 11 is higher than a current engine speed by an engine speed difference corresponding to an additional load, for example, in order to provide the engine 11 with such an additional load that an overload is not applied to the engine 11.

Specifically, the variation reducing unit E3 receives an allowable torque $T_{limit}$ calculated by the torque limiting unit E2, a target engine speed $\omega^*$, and an actual engine speed $\omega$ detected by an engine speed sensor (not depicted) as inputs, and calculates a torque limit $T''_{limit}$ using Formula (4). The coefficient $K_P$ is a proportional constant and the coefficient $K_I$ is an integral constant.

$$T''_{limit} = (\omega^* - \omega) \times K_P + \int (\omega^* - \omega)dt \times K_I = \Delta\omega \times K_P + \int \Delta\omega dt \times K_I \quad (4)$$

More specifically, a dashed line in FIG. 5 (A) indicates a temporal transition of an allowable torque $T_{limit}$, and a solid line in FIG. 5 (A) indicates a temporal transition of a torque limit $T''_{limit}$ calculated using Formula (4). A dashed line in FIG. 5 (B) indicates a temporal transition of an engine speed for when the variation reducing unit E3 is not provided, that is, for when an allowable torque $T_{limit}$ is input to the flow rate command calculating unit E4 instead of a torque limit $T''_{limit}$. A solid line in FIG. 5 (B) indicates a temporal transition of an engine speed for when the variation reducing unit E3 is provided, that is, for when a torque limit $T''_{limit}$ calculated by using Formula (4) is input to the flow rate command calculating unit E4.

At the time t1, when the right operating lever 26R is operated in the boom-lifting direction, a control pressure detected by the control pressure sensor 19 decreases because the control valve 175 moves to shut off the center bypass pipe line 40. Therefore, a required flow rate Q*, which is calculated based on the control pressure, increases as the control pressure decreases. Meanwhile, a discharge pressure P detected by the discharge pressure sensor 28 increases in response to an increase in an actual discharge rate due to an increase in the required flow amount Q*. Therefore, a required torque T*, which is calculated on the basis of the required flow rate Q* and the discharge pressure P, increases sharply, and an allowable torque $T_{limit}$, which is calculated on the basis of the required torque T*, also increases sharply, as indicated by the dashed line in FIG. 5 (A).

Then, in a case where the variation reducing unit E3 is not provided, that is, in a case where an allowable torque $T_{limit}$ is input to the flow rate command calculating unit E4 instead of a torque limit $T''_{limit}$, an engine speed decreases as indicated by the dashed line in FIG. 5 (B). This is because the absorbing torque of the main pump 14 temporarily exceeds the actual torque of the engine 11. This is because a flow rate command value Q, that is, an actual discharge rate of the main pump 14 becomes greater than that for when the variation reducing unit E3 is provided, that is, for when a torque limit $T''_{limit}$, which is calculated using Formula (4), is input to the flow rate command calculating unit E4. Such a sharp increase in the actual discharge rate of the main pump 14 may occur also in a case where a required flow rate Q* is used, as it is, as a flow rate command value Q.

Therefore, in the example of FIG. 5, as in the example of FIG. 4, the controller 30 determines a flow rate command value Q based on a torque limit $T''_{limit}$ calculated using Formula (4), thereby reducing a sharp increase in an actual discharge rate of the main pump 14. As a result, the controller 30 can maintain an engine speed as indicated by the solid line in FIG. 5 (B) and prevent a significant decrease in an engine speed as indicated by the dashed line in FIG. 5 (B). This is because the controller 30 can prevent an absorbing torque of the main pump 14 from exceeding an actual torque of the engine 11. Specifically, this is because, the controller 30 is capable of not sharply increasing an absorbing torque of the main pump 14 and gradually increasing an absorbing torque of the main pump 14, by employing a value, higher than a present engine speed, as a target engine speed $\omega^*$ by an engine speed difference corresponding to such an additional load that an overload is not applied to the engine 11.

As described above, the excavator 100 includes the lower traveling body 1, the upper turning body 3 that is pivotally installed to the lower traveling body 1, the engine 11 that is installed in the upper turning body 3, the main pumps 14 as oil hydraulic pumps driven by the engine 11, and the controller 30 that controls flow rates of hydraulic oil discharged by the main pumps 14. The controller 30 delays (reduces) a response of the main pump 14 until an actual torque of the engine 11 rises to a level corresponding to a load when the load of the engine 11 is increased.

This arrangement ensures that the excavator 100 can more surely prevent an absorbing torque of the main pump 14 from exceeding an actual torque of the engine 11. In other words, the excavator 100 can efficiently increase an absorbing torque of the main pump 14, that is, an actual torque of the engine 11. This is because the excavator 100 can limit a discharge rate of the main pump 14 in advance taking into account a delay in rising up of an engine output. This is because the excavator 100 can operate taking into account a dynamic change in an actual torque of the engine 11.

Therefore, the excavator 100 can reduce a decrease in an engine speed. As a result, the excavator 100 can improve fuel economy. The excavator 100 can also reduce an operator's discomfort caused by an engine speed variation during the operator's operation.

Further, by employing the variation reducing unit E3, the excavator 100 can prevent an absorbing torque of the main pumps 14, that is, an engine load from increasing sharply, and can prevent an engine speed from becoming unstable, even when a boost pressure is relatively high as well as even when a boost pressure is relatively low.

The controller 30 may cause an increase in a flow rate of hydraulic oil discharged by the main pump 14 to correspond to a rise of an actual torque of the engine 11, in a manner other than the manners described above. For example, the controller 30 may increase a flow rate of hydraulic oil discharged by the main pump 14 at a rate corresponding to an increase in an actual torque of the engine 11. In this case, the rate of an increase of a flow rate of hydraulic oil discharged by the main pump 14 may be predetermined based on at least past data, a simulation result, or the like.

The controller 30 may reduce an increase in a flow rate command value Q corresponding to a flow rate of hydraulic oil actually discharged by the main pump 14, in response to an increase in a required flow rate Q*, which is a flow rate of hydraulic oil to be discharged by the main pump 14, by a method other than the method of the above-described embodiments. The controller 30 may calculate a torque limit $T''_{limit}$ based on a required torque T* required to achieve a required flow rate Q* and calculate a flow rate command value Q based on the torque limit $T''_{limit}$, in a method other than the method of the above-described embodiments.

The embodiments of the present invention have been described in detail above. However, embodiments of the present invention are not limited to the embodiments described above. Various modifications, substitutions, and the like may be made on the embodiments described above without departing from the scope of the present invention. Also, features described above separately may be combined unless there occurs a technical inconsistency.

For example, in the above-described embodiments, the oil hydraulic system installed in the excavator 100 is capable of performing negative control as an energy saving control, but may be capable of performing positive control, load sensing control, or the like. If positive control is performed, the controller 30 may, for example, calculate a required flow rate Q* based on an operating pressure detected by the operating pressure sensor 29. When load sensing control is performed, the controller 30 may calculate a required flow rate Q* based on, for example, an output of a load pressure sensor for detecting a pressure of hydraulic oil in the actuator and a discharge pressure detected by the discharge pressure sensor 28.

Further, in the above-described embodiments, the controller 30 performs a variation reducing process when a boom-lifting operation is performed, but may perform a variation reducing process also when at least an operation such as a boom-lowering operation, an arm-closing operation, an arm-opening operation, a bucket-closing operation, a bucket-opening operation, a turning operation, or a traveling operation is performed.

In addition, with regard to the embodiments described above, the oil hydraulic operating levers with the oil hydraulic pilot circuits are disclosed. For example, in an oil hydraulic pilot circuit for the left operating lever 26L, hydraulic oil supplied by the pilot pump 15 to the left operating lever 26L is transferred to the pilot port of the control valve 176 at a flow rate corresponding to a degree of opening of a remote control valve which is opened or closed by tilting in an arm-opening direction of the left operating lever 26L. In the oil hydraulic pilot circuit for the right operating lever 26R, hydraulic oil supplied by the pilot pump 15 to the right operating lever 26R is transferred to the pilot port of the control valve 175 at a flow rate corresponding to a degree of opening of the remote control valve which is opened or closed by tilting the right operating lever 26R in the boom-lifting direction.

However, electric operating levers with electric pilot circuits may be employed instead of the oil hydraulic operating levers with the oil hydraulic pilot circuits. In this case, a lever operation amount of an electric operating lever is input to the controller 30, for example, as an electrical signal. Solenoid valves are provided between the pilot pump 15 and the pilot ports of the respective control valves. The solenoid valves operate in response to electrical signals from the controller 30. This arrangement allows the controller 30 to move each control valve by controlling the solenoid valve in response to an electrical signal corresponding to an amount of a lever being operated by the operator, thereby increasing or decreasing a pilot pressure.

It should be understood that the invention is not limited to the above-described embodiments, but may be modified into various forms on the basis of the spirit of the invention. Additionally, the modifications are included in the scope of the invention.

What is claimed is:

1. An excavator, comprising:

a lower traveling body;

an upper turning body pivotally installed to the lower traveling body;

an engine installed in the upper turning body;

an oil hydraulic pump driven by the engine;

a memory; and a processor coupled to the memory and configured to control a flow rate of hydraulic oil discharged by the oil hydraulic pump, wherein the processor is configured to calculate a torque limit based on a required torque required to achieve a required flow rate that is the flow rate of the hydraulic oil required to be discharged by the oil hydraulic pump, and delay a response of the oil hydraulic pump by gradually increasing the calculated torque limit until an actual torque of the engine rises to a level corresponding to a load of the engine, when the load of the engine increases.

2. The excavator as claimed in claim 1, wherein the processor is further configured to cause an increase in the flow rate of the hydraulic oil discharged by the oil hydraulic pump to correspond to rising up of the actual torque of the engine.

3. The excavator as claimed in claim 1, wherein the processor is further configured to reduce an increase in the flow rate of the hydraulic oil actually discharged by the oil hydraulic pump in response to an increase in the required flow rate.

4. The excavator as claimed in claim 1, wherein the processor is further configured to calculate a flow rate command value based on the torque limit.

5. The excavator as claimed in claim 1, wherein the processor is further configured to calculate a flow rate command value that delays the response of the oil hydraulic pump also before the load of the engine increases.

6. The excavator as claimed in claim 1, wherein the processor is further configured to calculate the torque limit that delays the response of the oil hydraulic pump also before the load of the engine increases.

7. The excavator as claimed in claim 1, wherein the processor is further configured to estimate an output state of the engine based on the required flow rate.

8. The excavator as claimed in claim 7, wherein the processor is further configured to reduce an increase in the flow rate of the oil hydraulic pump based on the estimated output state of the engine.

* * * * *